US008096808B2

(12) United States Patent
Trotsky et al.

(10) Patent No.: US 8,096,808 B2
(45) Date of Patent: Jan. 17, 2012

(54) ALTERNATIVE STEEL AND CONCRETE TARGET

(75) Inventors: Joey Trotsky, Oxnard, CA (US); Jeff Karrh, Ventura, CA (US); Joseph Saenz, Camarillo, CA (US); Leslie Ann Karr, Oak View, CA (US); Luis Javier Malvar, Newbury Park, CA (US); James E. Tancreto, Camarillo, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 833 days.

(21) Appl. No.: 12/186,736

(22) Filed: Aug. 6, 2008

(65) Prior Publication Data

US 2010/0035216 A1 Feb. 11, 2010

(51) Int. Cl.
*F41A 33/00* (2006.01)

(52) U.S. Cl. ..... 434/11

(58) Field of Classification Search ..... 434/11, 434/15, 16, 23; 273/317, 348; 52/125.3, 52/125.4, 649.1, 223.7, 294, 414; 89/1.11, 89/1.1, 36.02, 920, 937

See application file for complete search history.

(56) References Cited

U.S. PATENT DOCUMENTS

| | | | | |
|---|---|---|---|---|
| 1,574,180 | A * | 2/1926 | Strauss | 296/203.01 |
| 1,949,079 | A * | 2/1934 | Loeffler | 52/599 |
| 2,971,295 | A * | 2/1961 | Reynolds | 52/223.7 |
| 3,315,430 | A * | 4/1967 | Reynolds et al. | 52/599 |
| 4,253,670 | A * | 3/1981 | Moulton et al. | 273/348.1 |
| 4,428,174 | A * | 1/1984 | Grady, II | 52/745.13 |
| 4,625,972 | A * | 12/1986 | Task et al. | 273/348 |
| 4,726,567 | A * | 2/1988 | Greenberg | 256/19 |
| 6,973,864 | B1 * | 12/2005 | Ahmad | 89/36.02 |

FOREIGN PATENT DOCUMENTS

GB 2130275 A * 5/1984

* cited by examiner

*Primary Examiner* — Gene Kim
*Assistant Examiner* — Alyssa Hylinski
(74) *Attorney, Agent, or Firm* — Robert R. Lerma

(57) ABSTRACT

An alternative steel and concrete target configurable to represent a wide variety of military surplus vehicles is described herein. The alternative steel and concrete target is used as a hard target for training on high explosives bombing ranges.

26 Claims, 8 Drawing Sheets

ALTERNATIVE STEEL AND CONCRETE TARGET

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefore.

BACKGROUND OF THE INVENTION

1. Field of the Invention

The invention generally relates to a military target for training on high explosive (HE) bombing ranges. The present invention is an alternative to using military surplus vehicles as targets on HE bombing ranges.

2. Description of Related Art

The targets currently in wide spread use at DoD HE bombing ranges are known as hard targets. Hard targets are traditionally surplus military equipment, such as old tanks and armored personnel carriers (APC). The surplus military equipment is typically delivered to the range from the Defense Reutilization and Marketing Office (DRMO), generally at little to no cost to the bombing range. While the hard target arrives at no cost to the bombing range, the range still incurs a significant expense to properly prepare the hard target, demilitarize the hard target, transport the hard target to the impact area, maintain hard target fidelity after transport, transport a used hard target off the bombing range, and finally to permanently dispose of the used hard target.

A partial solution to using surplus military equipment is the GreenTarget®. However, the GreenTarget® suffers from a myriad of problems some of which are: it is not meant for use on HE bombing ranges where it would have low survivability, it has high acquisition cost; and it is only available from a sole source supplier. Each GreenTarget® is manufactured from steel plates sized and fabricated for each application. Depending on the target application, steel plate thickness varies from ⅝ inch to 1 inch, allowing the target to only be suitable for ranges that do not train with HE bombs.

Another partial solution to the problem of using surplus military equipment is the Joint Modular Ground Target (JMGT). The main problem with a JMGT is that it is incompatible for use as an HE hard target. Additionally, it has low strength, is not durable, and has a high acquisition cost. The JMGT is a building block style target that can withstand multiple low intensity hits. While visually correct and relatively low cost, JMGTs are not useful as hard targets due to the low rate of survivability.

Actual surplus military vehicles are highly desirable for use as hard targets because of their durability and their threat representation qualities. However, these surplus military vehicles when used as targets present environmental and operational challenges because of their environmental impacts, high life-cycle costs, occupational and explosive safety concerns, and more importantly their limited availability. Traditional hard targets, such as a surplus M-60 tank or APC, present environmental liabilities for range managers. The M-60 tank and APC slated for use as hard targets must be carefully prepared to meet environmental requirements. The hard target preparation includes the removal of significant quantities of hazardous, radiological, and special waste materials including: petroleum oils, and liquids, fuel, coolant, lubricants, low-level radioactive waste, asbestos containing items, solid-state electronic components, fire suppression equipment, engines, and drive train components.

In addition to the environmental waste products generated from the target preparation, actual use of the traditional hard target on-range also presents a significant environmental liability to the range manager. During hard target preparation it is understood that not all of the hazardous waste materials are recovered. Inevitably, residual hazardous waste material will remain trapped within the components of an M-60 tank or APC due to the difficulties in extracting all of the fluids from all reservoirs within the vehicle and there will be releases of hazardous material to the environment.

The alternative steel and concrete target overcomes the environmental and operational limitations present when using military surplus vehicles as a hard target by resolving the problems related to procurement, preparation, and the assumption of environmental liability. The alternative steel and concrete target eases the procurement problem by being easily built and assembled at a reasonable cost obviating the need to procure surplus military vehicles. The time to assemble the alternative steel and concrete target on the range is short. The environmental liability is eliminated by the selection of non-hazardous materials used to construct the alternative steel and concrete target. The alternative steel and concrete target is environmentally friendly and is expected to have life-cycle costs that approximate those commonly encountered when using an M-60 tank.

SUMMARY OF THE INVENTION

The present invention is directed to an apparatus that satisfies the need to have a readily available, easily assembled, low cost hard target for use in testing high explosive ordnance. The apparatus is an alternative steel and concrete target comprising: a base structure of steel filled with concrete and at least one base structure threaded rod passing through the base structure. The base structure threaded rod includes a first threaded portion extending outward from a front side of the base structure, the base threaded rod includes a second threaded portion extending outward from a rear side of the base structure; a first nut threaded onto the first threaded portion of the base structure threaded rod; a second nut threaded onto the second portion of the base structure threaded rod; a concrete filled top module placed on top of and in physical contact with the base structure and at least one module threaded rod passing through the top module. The module threaded rod has a third threaded portion extending outward from the top module; a third nut threaded onto a third threaded portion of the module threaded rod; a pipe inserted into the top module through an opening, the pipe is welded to the top module at the point the pipe is in contact with an opening edge of the top module; and a mock gun barrel inserted into the pipe.

An embodiment of the alternative steel and concrete target was tested in conjunction with an M-60 tank using live MK-82 (500 lb) bombs. The damage to the prototype was evaluated and compared to the M-60 tank to assess survivability. The embodiment easily survived ten live fire events using the MK-82 (500 lb) at various distances, with the closest distance being from five feet away. The MK-82 is a free-fall, unguided, general purpose 500-pound bomb, commonly used by pilots for training on HE bombing ranges. The MK 80 series Low Drag General Purpose (LDGP) bombs are used in the majority of bombing operations where maximum blast and explosive effects are desired. The MK 82 bomb is categorized as a blast fragmentation weapon containing 192 pounds of HE material. The type of HE material used in the MK 82 bomb is either Tritonal, Minol II, or H-6.

BRIEF DESCRIPTION OF THE DRAWINGS

The features described above, other features, aspects, and advantages of the present invention will become better understood with regard to the following description, appended claims, and accompanying drawings where:

DETAILED DESCRIPTION OF THE PREFERRED EMBODIMENT

Figure 1A:
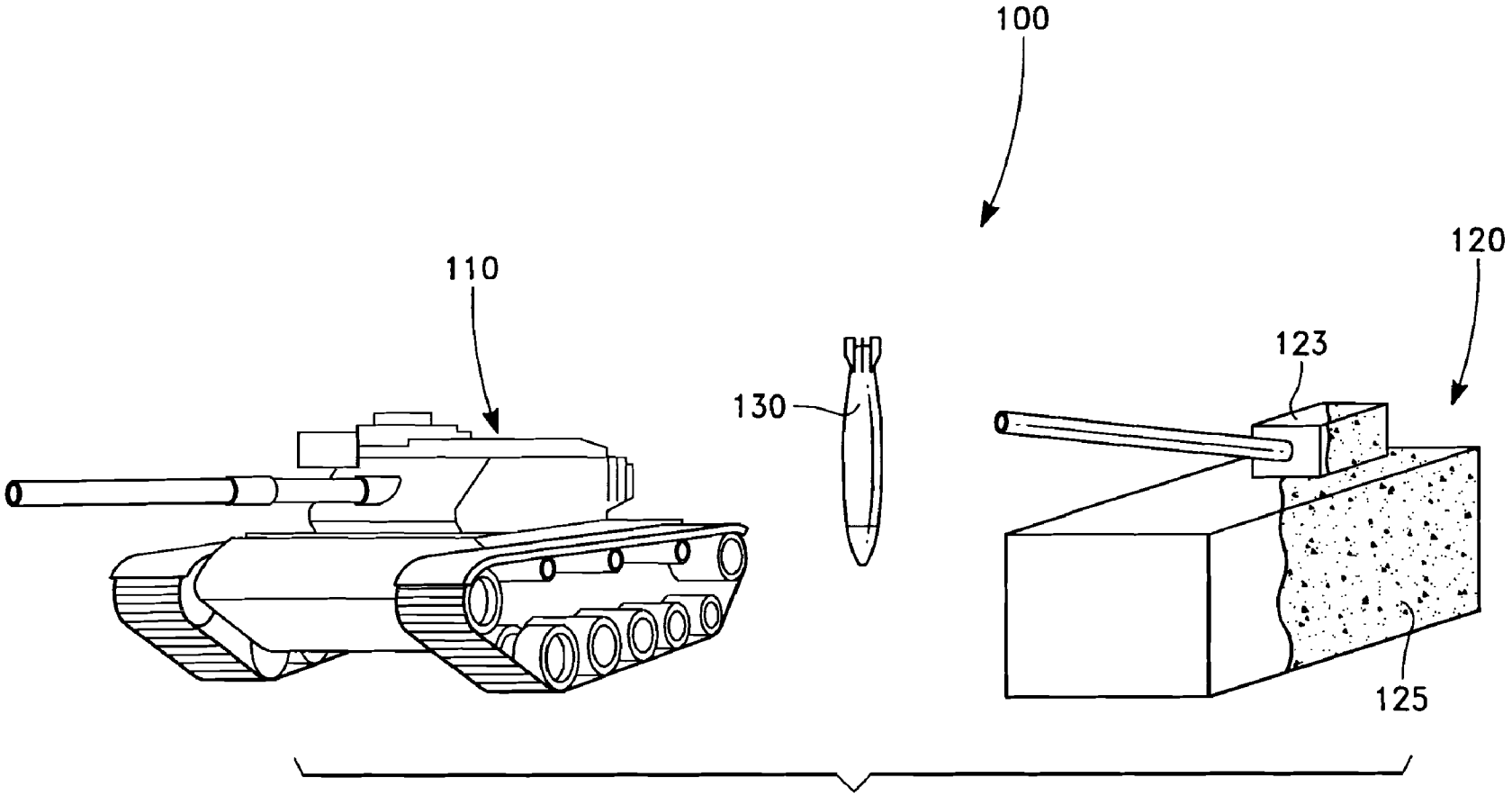
FIG. 1*a* is a drawing of a typical high explosive bombing range configuration depicting an M-60 tank target, an alternative steel and concrete target in the shape of an M-60 tank, and an incoming bomb.

Referring to FIG. 1*a*, depicted is a representative placement of a surplus M60 tank 110 and an alternative steel and concrete target 120 in use on a high explosive (HE) bombing range 100. Generally, the bomb 130 containing a quantity of HE is dropped onto the bombing range 100 during a training exercise such that it will explode near a pre-positioned target (110, 120). A mild steel skin 123 is used to clad a concrete interior core 125, together the mild steel skin 123 and the concrete interior core 125 provide the structural integrity to withstand an HE blast that propels fragments at a high velocity.

Figure 1B:
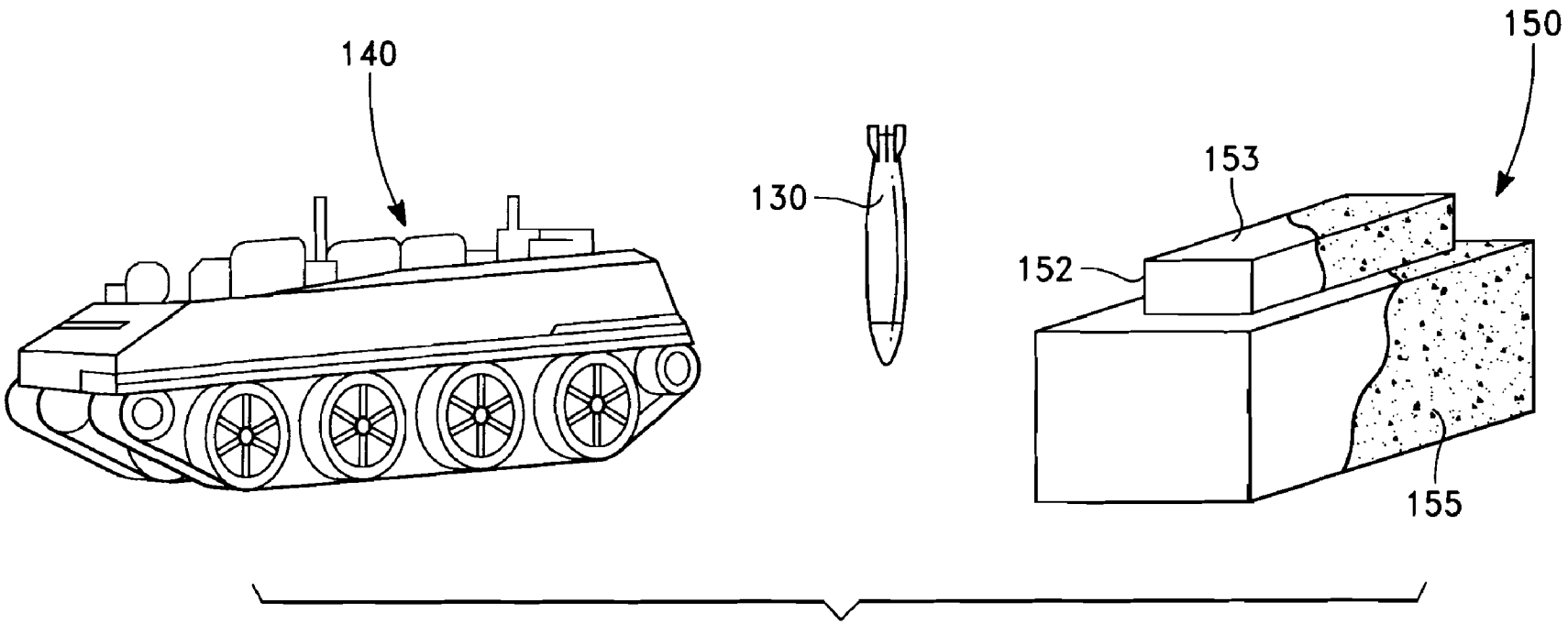
FIG. 1*b* is a drawing of a typical high explosive bombing range configuration depicting an armored personnel carrier, an alternative steel and concrete target in the shape of an armored personnel carrier, and an incoming bomb.

Referring to FIG. 1*b*, in another embodiment, an alternative steel and concrete target 150 is in the shape of an armored personnel carrier 140. A mild steel skin 153 is used to clad a concrete interior core 155, together the mild steel skin 153 and the concrete interior core 155 provide the structural integrity to withstand an HE blast that propels fragments at a high velocity.

One skilled in the art of building bombing targets is able to reshape the preferred embodiments represented in FIG. 1*a* 120 or FIG. 1*b* 150 to simulate any number of surplus military vehicle configurations.

Figure 2:
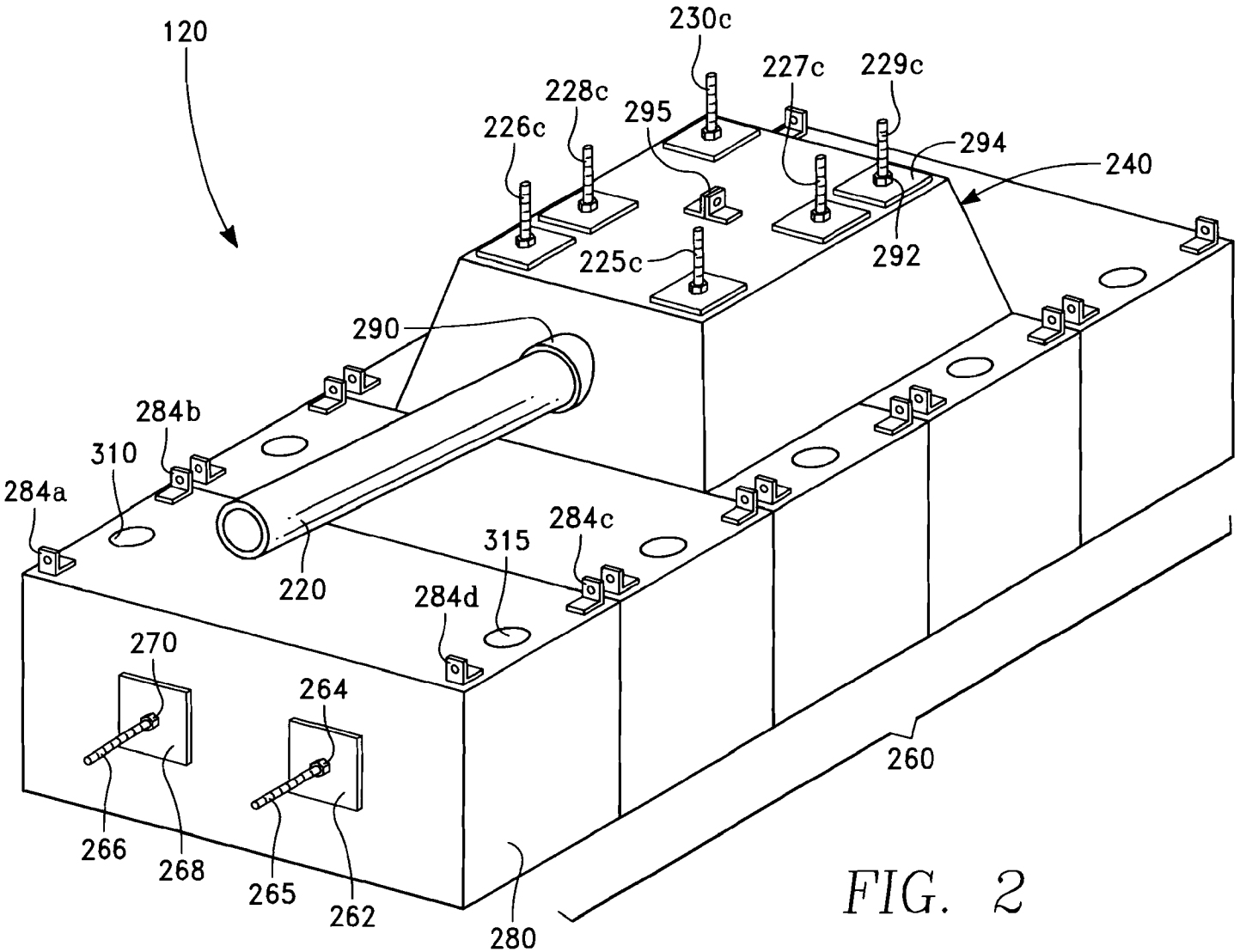
FIG. 2 is a drawing of the alternative steel and concrete target showing a base structure and a turret shaped top module.

Referring to FIG. 2, the alternative steel and concrete target 120 is a modular structure that is designed to withstand blast fragmentation damage. The survivability of the alternative steel and concrete target is determined by monitoring and assessing the blast fragmentation damage. When damage causes the target to lose its fidelity, it is no longer a usable target. In the preferred embodiment, the major portions of the alternative steel and concrete target 120 are comprised of a base structure 260, a top module in the shape of a turret 240, and a gun barrel 220. The top module in the shape of a turret 240 is not restricted to the shape of a turret. Referring to FIG. 1*b*, in another embodiment the top module 152 is rectangular in shape to simulate an armored personnel carrier. The preferred base structure 260 is comprised of a plurality of separate base modules 280 that are separately built and assembled at or very near the bomb impact area. In another embodiment the base structure 260 is comprised of at least one base module 280 that is separately built and assembled at or very near the bomb impact area. The base structure 260 presents a footprint that is flexible in size. The flexibility of the footprint is accomplished by varying the size and quantity of the base module 260. The overall dimensions for the preferred base structure 260 are: eight feet wide, fifteen feet long, and five feet tall. These dimensions define a footprint for the alternative steel and concrete target 120 resulting in a hard target that is approximately three-quarters the size of a surplus M-60 tank. An alternative steel and concrete target 120 that is less than three-quarter size of a surplus M-60 tank begins to negatively impact the visual fidelity of the target, relative to the observation made by a bomber pilot.

Figure 3:
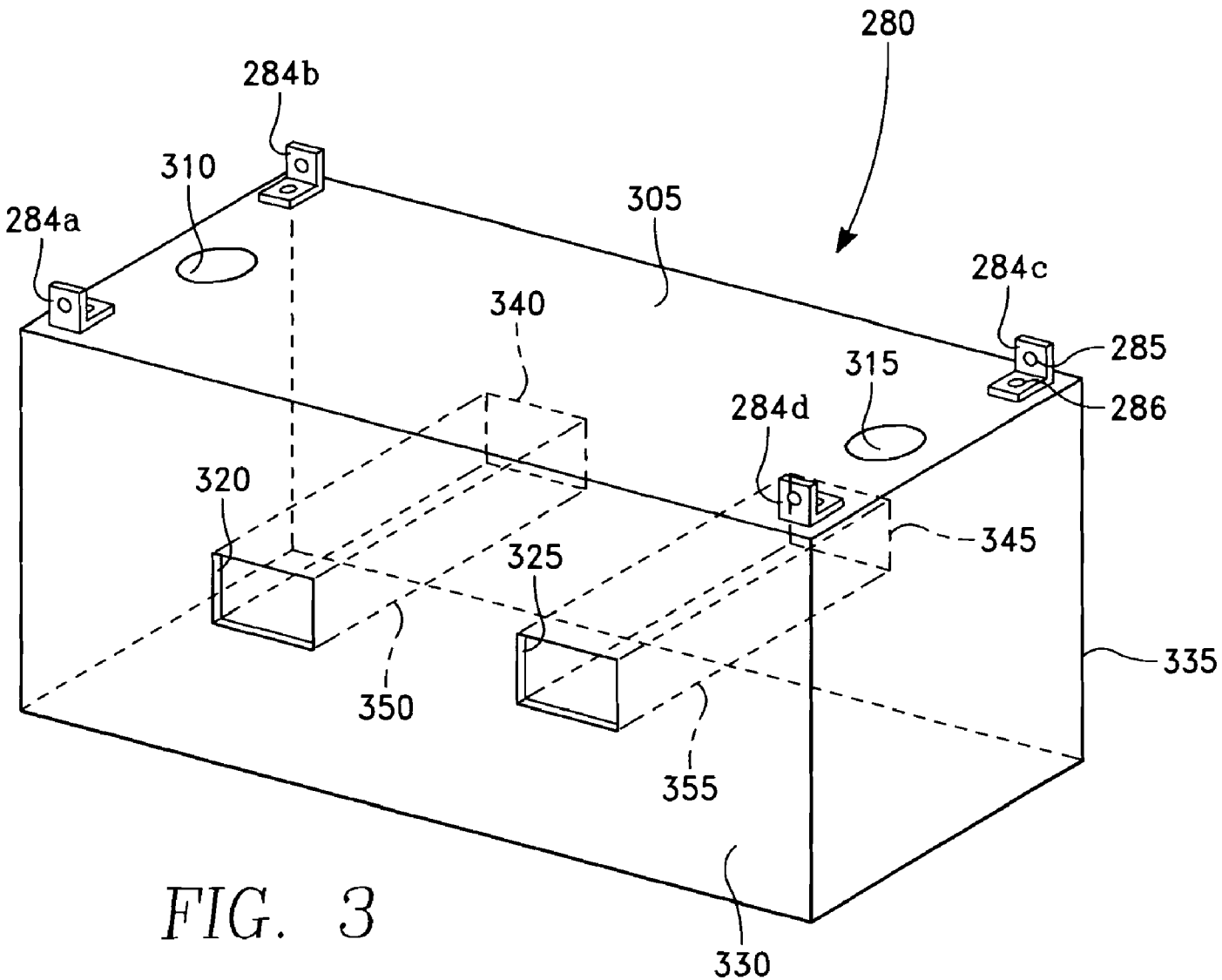
FIG. 3 is a detailed drawing of a base module that is used as part of the base structure.

The base module 280 is a core feature that makes the alternative steel and concrete target (FIG. 2 120) a viable replacement for surplus military vehicles by providing a means for rapid reconfiguration into a variety of shapes. Referring to FIG. 3 280, the preferred base module 280 is built so its weight does not exceed the limitations of the typical logistical equipment available on bombing ranges. Each base module 280 is a welded, six sided enclosure, resulting in a steel box that is later filled with a concrete mixture having a compressive strength of at least four thousand pounds per square inch (psi) when cured. For the preferred embodiment a mild steel is used to construct the base module 280 and is at least one quarter inch in thickness. Another embodiment of the invention has a thicker set of mild steel cladding around the sides of the base module 280 exposed to the HE blast, for example a two inch thick cladding. The thicker set of mild steel cladding may be less than two inches in thickness if more damage to the base module 280 is tolerable. The thickness of the steel cladding (123, 153) is directionally proportional to the overall survivability of the alternative concrete and steel target.

Blast effect modeling is a method of using a software application tailored for modeling the penetration of fragments propelled from an HE detonation and for modeling a corresponding explosion. The explosion model produces a blast fragmentation pattern that impinges upon a target having its characteristics set by the software application parameters. The blast effect model is particularly useful in providing a means for the user to vary the set of target characteristics and arrive at an optimum combination of target characteristics for a given explosion and blast fragmentation pattern.

The blast effect model used to arrive at the preferred embodiment that is the alternative steel and concrete target (FIG. 2 120) was performed using ConWep, a software application obtained from the U.S. Army Corps of Engineers. ConWep target modeling revealed that as the compressive strength of the concrete used to fill the base module 280 increased, the penetration depth of the blast fragments into a modeled base module decreased. The ConWep modeling and analysis resulted in selecting the highest compressive strength concrete readily available for use in the preferred embodiment.

Referring to FIG. 3, two nine inch diameter holes (310, 315) are cut into the top side 305 of each base module 280. One hole 310 is cut towards one end of the base module 280 and the other hole 315 is cut towards the opposite end of the base module 280. The two nine inch diameter holes (310, 315) allow wet concrete to be poured into the base module 280. The two nine inch diameter holes (310, 315) are sized to allow a mechanical vibrator to be used to settle the wet concrete that fills the base module 280.

In the preferred embodiment two rectangular holes (320, 325) dimensioned at six inches by nine inches are cut into one side 330 of the base module 280. A like set of rectangular holes (340, 345) are cut into the opposite side 335 of the base module 280. The holes 320 and 340 are aligned, and the holes 325 and 345 are aligned, to accommodate the tines of a forklift. The aligned holes (320 with 340, 325 with 345) also serve as openings for accepting a means to strengthen the base module 280 and to secure, or draw together, a plurality of adjacent base modules 280 that comprise the base structure 260 of FIG. 2. The preferred embodiment of the base module 280 includes a connecting channel (350, 355) that connects the aligned holes (320 with 340, 325 with 345), respectively. The connecting channel (350, 355) prevents wet concrete from seeping from the base module 280 when filling and also creates a passage through the cured concrete for inserting the means to draw the plurality of base modules 280 together. In another embodiment the aligned holes (320 with 340, 325 with 345) are not rectangular. Referring to FIG. 2, in the preferred embodiment the means to secure and strengthen the base module 260 is a threaded rod (FIG. 2, 265 or 266) having a length sufficient to pass through all of the adjacent modules that are used to create the base structure 260. The threaded rod must have enough length to accommodate a flat square washer (262, 268) and a nut (264, 270) at each end. The preferred threaded rod (265, 266) is a 1¼"-7 B7 steel alloy type. The threaded rods (265, 266) are used to draw a plurality of base modules 280 together in a compressive fashion in order to eliminate, to the extent possible, the space between adjacent base modules 280 used to construct the base structure 260. The threaded rods (265, 266) also provide strength by keeping the concrete mixture used to fill the base module 280 from expanding the walls when the concrete is poured. A forklift or a crane is used to lift and move the unfilled base module 280 from its point of construction to the site selected for filling it with concrete.

Referring to FIG. 3, in order to facilitate moving the base module 280 after it has been constructed a plurality of lifting points in the form of angle iron shaped to form lifting brackets (284*a*, 284*b*, 284*c*, 284*d*) are welded to the top side 305 of the base module 280 near each of the four corners. Each lifting bracket (284*a*, 284*b*, 284*c*, 284*d*) has a hole drilled into the vertical section for accepting a crane shackle and has a hole drilled into the horizontal section for accepting a reinforcing threaded metal rod (FIGS. 6*a* and 6*b* items 615 and 630 respectively) when needed.

When the base module 280 is not filled with the concrete mixture the lifting brackets (284*a*, 284*b*, 284*c*, 284*d*) will support lifting and moving the base module 280. The lifting brackets (284*a*, 284*b*, 284*c*, 284*d*) will not support lifting and moving a concrete filled base module 280.

Figure 4A:
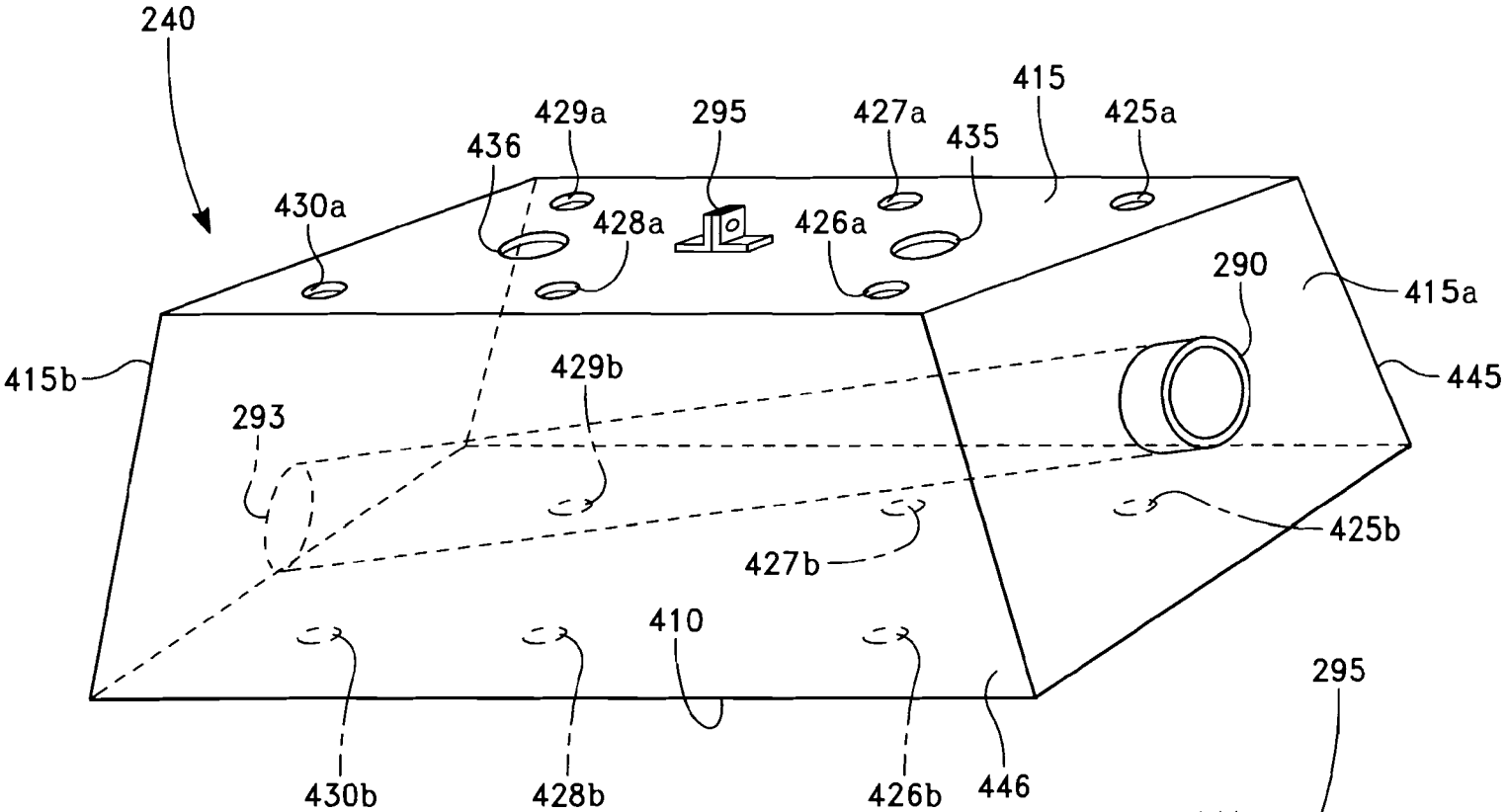
FIG. 4*a* is a detailed drawing of the turret shaped top module that is mounted on top of the base structure. Depicted is a single lifting bracket that accepts a crane shackle that is used to lift an unfilled turret shaped top module.

Referring to FIG. 4*a*, the top module 240 is formed in the shape of a turret when the alternative steel and concrete target (FIG. 1, 120) is configured to represent a surplus tank target (FIG. 1, 110). In the preferred embodiment the turret shaped top module 240 is two feet in height and comprised of a top section 415 that is five feet square, a bottom section 410 that is six feet square, and side walls 445 and 446. The top section 415, the bottom section 410, and the side walls 445 and 446 are all welded together to form an enclosure that is filled with the same type of concrete that is used to fill the base module (FIG. 3, 280).

In an effort to reduce the overall amount of welding and to strengthen the top module 240, the top section 415 is formed from a single piece of steel that is bent into the form of a channel resulting in the formation of a front side 415*a* and a back side 415*b*. Generally, a steel company that provides the raw materials to construct the preferred embodiment of the alternative steel and concrete target 120 in FIG. 1 will provide the single piece of steel bent into the form of a channel.

In another embodiment the top module 240 is constructed of a plurality of steel plates in lieu of a bent channel. The top section 415, the front side 415*a* and the back side 415*b* are individual steel plates welded together.

A hole ten inches in diameter is cut into the front side 415*a* of the top module 240 for accepting a pipe 290 that will serve as structural support for a mock gun barrel (FIG. 2, 220). An end plate 293 is also welded at the end of the pipe 290 to keep the wet concrete mixture from pouring in and filling the pipe 290. The pipe 290 is six feet long, is ten inches in diameter, and is made from steel that is at least one half inch in thickness. The pipe 290 is welded to the front side 415*a* along that portion of the pipe in direct contact with the edges of a hole cut into the front side 415*a*.

The top section 415 has six top holes (425*a*, 426*a*, 427*a*, 428*a*, 429*a*, 430*a*) cut into it. Each top hole is six inches in diameter and is positioned such that an imaginary line passing perpendicular to the top section 415 will not intersect the pipe 290. Each top hole (425*a*, 426*a*, 427*a*, 428*a*, 429*a*, 430*a*) serves as an opening through which a threaded steel rod (FIG. 2, 225*c*, 226*c*, 227*c*, 228*c*, 229*c*, 230*c*) will pass. Two additional holes (435, 436) are cut into the top section 415 and serve as openings for pouring the wet concrete mixture into the top module 240. A lifting bracket 295 is welded to the top section 415 for the purpose of facilitating the lifting and positioning of the top module 240 when it is not filled with the concrete mixture.

Figure 4B:
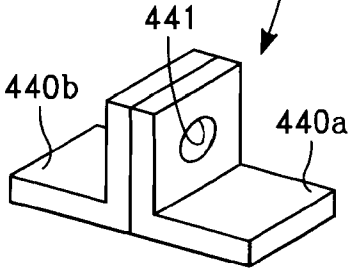
FIG. 4*b* is a detailed drawing showing the pieces of angle iron forming a lifting bracket configured to act as a lifting point for the unfilled turret shaped top module.

Referring to FIGS. 4*a* and 4*b*, the top module lifting bracket 295 is comprised of two four inch angle brackets (440*a*, 440*b*) mounted back to back, where each top module lifting bracket 295 is made from one half inch thick steel. Each of the angled brackets (440*a*, 440*b*) has sides that are perpendicular, with each side approximately six inches square. The horizontal side of each angle bracket (440*a*, 440*b*) is welded to the middle of the top section 415. The vertical section of each angle bracket (440*a*, 440*b*) is drilled through creating a hole 441 to accept a crane shackle for vertical lifting and placement. Referring to FIG. 4*a*, the bottom section 410 has six bottom holes (425*b*, 426*b*, 427*b*, 428*b*, 429*b*, 430*b*) cut into it such that they are in alignment with the six top holes (425*a*, 426*a*, 427*a*, 428*a*, 429*a*, 430*a*). Each bottom hole is six inches in diameter and serves as an opening through which a plurality of threaded steel rods (FIG. 2, 225*c*, 226*c*, 227*c*, 228*c*, 229*c*, 230*c*) will pass.

Referring to FIG. 2, the mock gun barrel 220 is a pipe that is twelve feet long, is eight inches diameter, and is made from one half inch steel pipe. In the preferred embodiment the type of pipe is SCH 80. The mock gun barrel 220 slides into the pipe 290. This allows the mock gun barrel 220 to be easily replaced when necessary.

Figure 5:
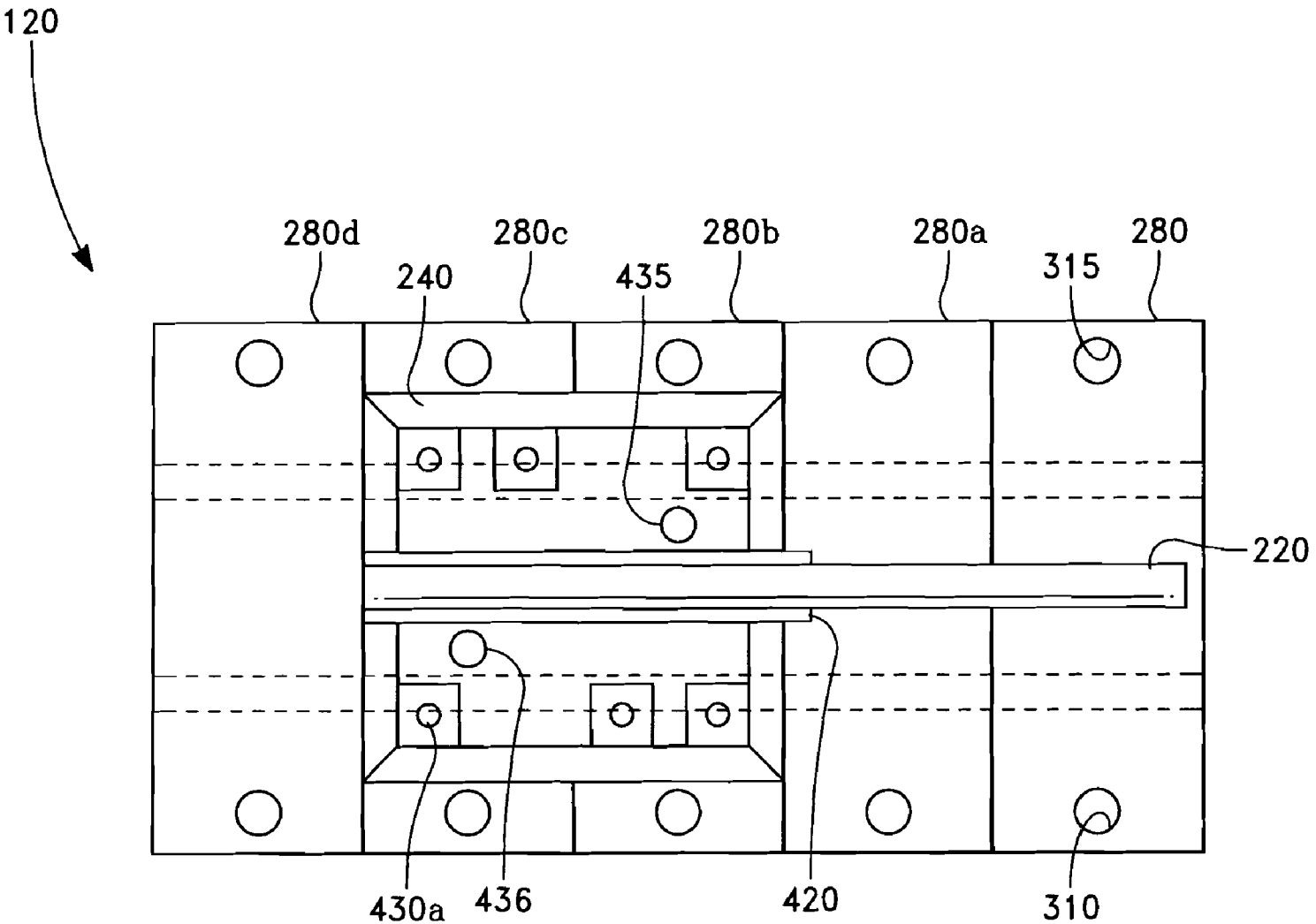
FIG. 5 is a top view diagram of an assembled alternative steel and concrete target in the form of a tank, using a plurality of base modules and the turret shaped top module.

Referring to FIGS. 2 and 5, shown is a top view diagram of a completely assembled alternative steel and concrete target 120 which includes dimensions and is configured to represent a surplus tank target (FIG. 1, 110). The preferred method of assembly is to build each base module (280, 280*a*, 280*b*, 280*c*, 280*d*) and the top module 240 at a facility remote from the bombing range. Then relocate the base modules (280, 280*a*, 280*b*, 280*c*, 280*d*), the top module 240, and a source of wet concrete to the bombing range for final assembly.

A forklift or crane is then used to position the base modules (280, 280*a*, 280*b*, 280*c*, 280*d*) as shown in FIG. 5. A pair of threaded rods are inserted through the plurality of aligned holes (320 and 340, 325 and 345) in each base module (280, 280*a*, 280*b*, 280*c*, 280*d*) and the base modules (280, 280*a*, 280*b*, 280*c*, 280*d*) are then drawn into direct contact by a tightening of the nuts (264, 270) on each threaded end (265, 266) of each threaded rod. At this point the base modules (280, 280*a*, 280*b*, 280*c*, 280*d*) are filled with wet concrete and then subjected to a vibration induced by a concrete vibrator to settle the wet concrete.

A forklift or crane is then used to place the top module 240 on top of the base structure 260 ensuring that the plurality of threaded steel rods (FIG. 2, 225*c*, 226*c*, 227*c*, 228*c*, 229*c*, 230*c*) are inserted through the six top holes (425*a*, 426*a*, 427*a*, 428*a*, 429*a*, 430*a*) and through the six bottom holes (425*b*, 426*b*, 427*b*, 428*b*, 429*b*, 430*b*), respectively. The top module 240 and the base structure 260 are drawn together by the tightening of a plurality of nuts, only one of the six nuts 292 is shown and referenced for clarity. The nut 292 is in direct contact with one side of a square washer 294 that is used to distribute a compressive force resulting from a tightening rotation of the nut 292. The compressive force prevents the top module 240 from being displaced in the presence of the blast overpressure. Once in place, the top module 240 is filled with concrete.

Another method of assembling the alternative steel and concrete target 120 is to fill the top module 240 and the base modules (280, 280*a*, 280*b*, 280*c*, 280*d*) with concrete after welding is completed at the facility that is remote from the bombing range. Once the top module 240 and the base modules (280, 280*a*, 280*b*, 280*c*, 280*d*) are filled with concrete specialized lifting equipment must be available on the test range. The preferred specialized lifting equipment is a Caterpillar 966F wheel loader configured with forks. The Caterpillar 966F can handle a maximum load in the range of 15,000 pounds (lbs.) to 18,000 lbs. The weight of a single concrete filled base module 280 is 13,126 lbs. The weight of a concrete filled top module 240 is 11,207 lbs. This brings the combined weight of the alternative steel and concrete target, when configured as a fully assembled tank target (FIG. 1*a*, 120), to approximately 77,000 lbs.

Figure 4C:
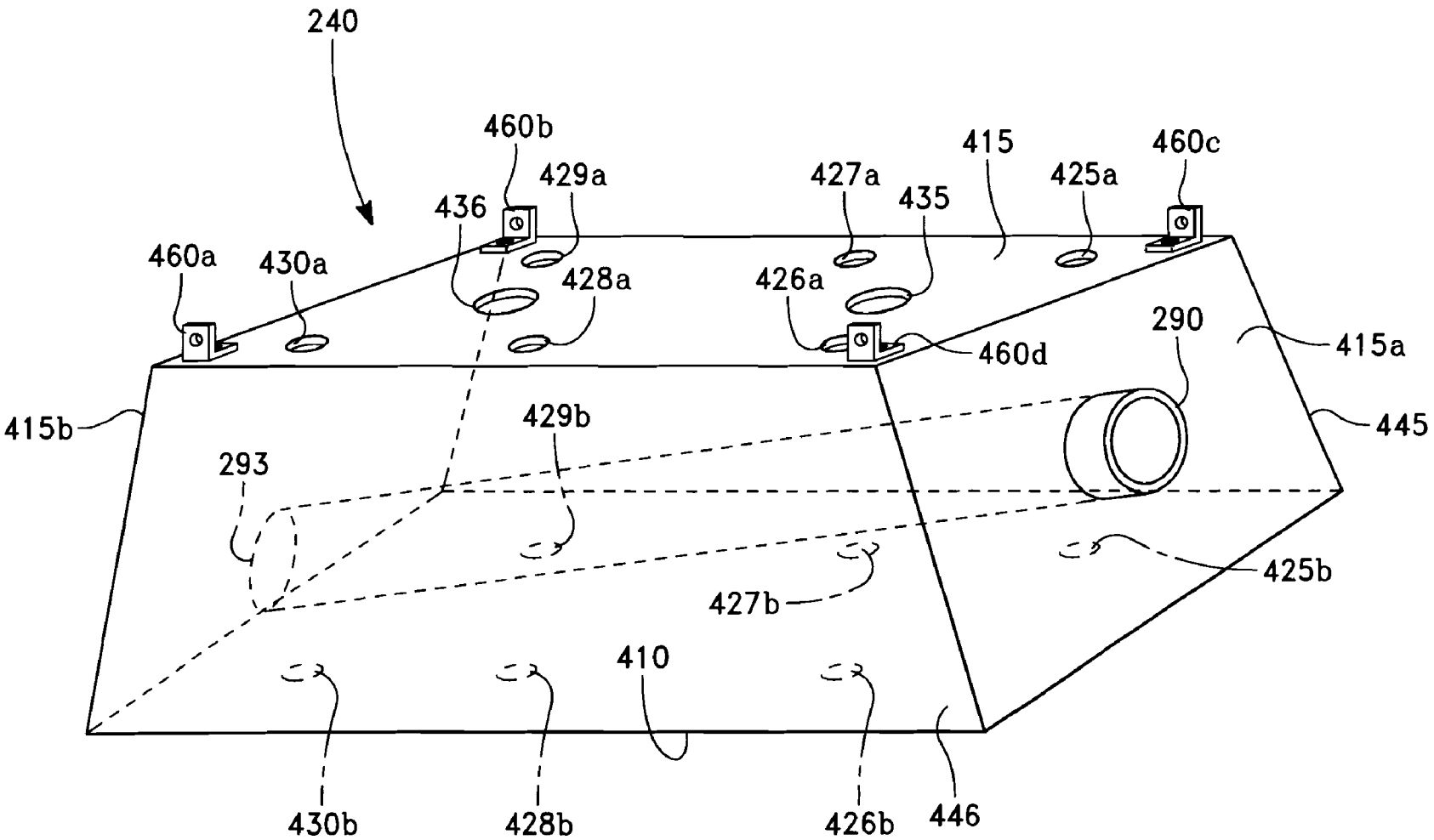
FIG. 4*c* is a detailed drawing of another embodiment of the turret shaped top module containing four lifting brackets that accept crane shackles for lifting a concrete filled turret shaped top module.
Figure 6B:
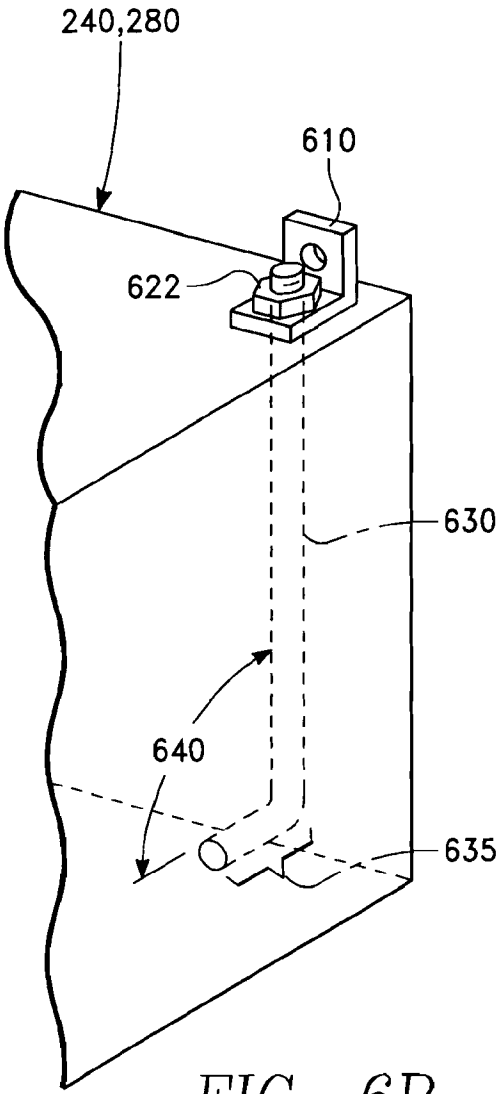
FIG. 6*b* is a sectional drawing depicting a second configuration that includes a lifting bracket with a reinforced threaded reinforcing rod that is bent at an angle. This second configuration is applicable to each lifting bracket that is part of the base module and the concrete filled turret top module.
Figure 6A:
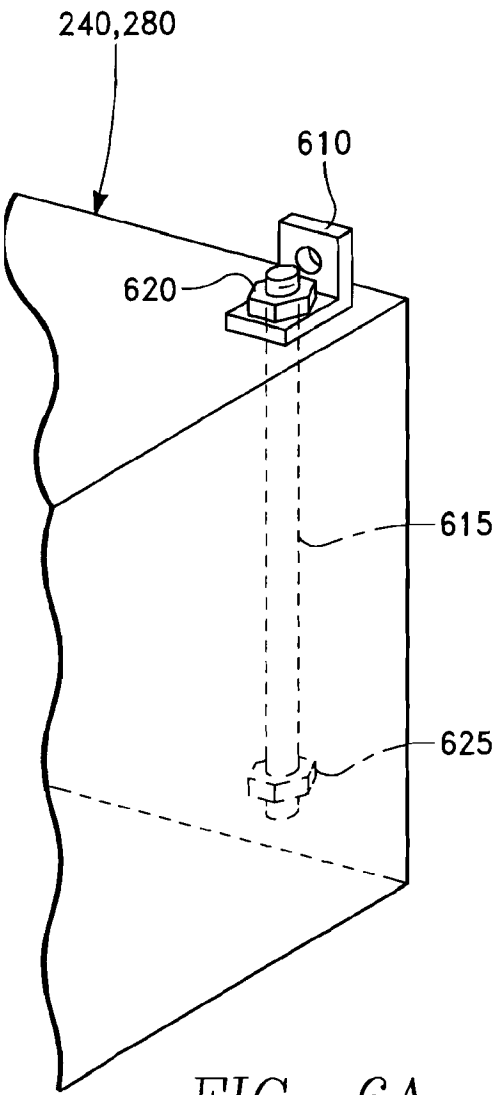
FIG. 6*a* is a sectional drawing depicting a first configuration that includes a lifting bracket with a reinforced threaded reinforcing rod and a nut. This first configuration is applicable to each lifting bracket that is part of the concrete filled base module and the concrete filled turret top module.

Referring to FIGS. 3 and 4*c*, when lifting or moving either a base module 280 that is filled with concrete or a top turret module 240 that is filled with concrete it is necessary to reinforce all of the respective lifting brackets (284*a*, 284*b*, 284*c*, 284*d*, 460*a*, 460*b*, 460*c*, 460*d*). The weld, on its own, that secures each lifting bracket (284*a*, 284*b*, 284*c*, 284*d*, 460*a*, 460*b*, 460*c*, 460*d*) is not sufficient to support the weight of a concrete filled base module or a concrete filled top turret module. Referring to FIGS. 6*a* and 6*b*, the reinforcing threaded metal rod (615, 630) provides a means to distribute the load between the weld and the concrete as depicted in the two embodiments, hereafter referred to as configurations. In yet another embodiment, the reinforcing threaded metal rod (615, 630) is at least ⅝ inches in diameter. Each of the two configurations requires the reinforcing threaded metal rod (615, 630) to be installed either before the concrete is poured or installed while the concrete is wet. An access hole, not shown because it is obscured by the lifting bracket 610, is cut into the top the top side of the base module 280 or the turret shaped top module 240, as applicable. The reinforcing threaded metal rod (615, 630) has a nut (620, 622) threaded on the end and is in contact with the lifting bracket 610. The nut (620, 622) prevents the reinforcing threaded metal rod (615, 630) from dropping completely into either the base module 280 or the top turret module 240 when inserted.

The first configuration, FIG. 6*a*, is a straight reinforcing threaded metal rod 615 that has a bottom nut 625 threaded onto the bottom end. The straight reinforcing threaded metal rod 615 is cut to a length that ensures that the straight reinforcing threaded metal rod 615 does not contact the bottom section of either the base module 280 or the top turret module 240 when inserted. The second configuration, FIG. 6*b*, is a bent reinforcing threaded metal rod 630 that has a bent portion 635 bent at an angle 640. The preferred angle 640 is approximately ninety degrees. The bent portion 635 serves the same purpose as the bottom nut 625, distributing the lifting load to the concrete. Referring to FIG. 1*b*, any one of the above assembly methods is applicable to building the alternative steel and concrete target 150 when configured as an armored personnel carrier 140.

Referring to FIGS. 1*a* and 2, although the several embodiments have been described in considerable detail with references to certain preferred versions thereof, other versions are possible. For example, modifying the dimensions of a base module 280, modifying the top module 240 shape or changing the overall dimensions of the base structure 260 results in an alternative steel and concrete target of any shape. Varying the strength of the concrete mixture used to fill the top module 240 and the base modules (280, 280*a*, 280*b*, 280*c*, 280*d*) results in the ability to control the survivability of the fully assembled alternative steel and concrete target 120 when subjected to multiple HE blasts. Any number of coatings may be applied to the exterior of alternative steel and concrete target 120. Coatings may enhance the detection or inhibit the detection of the alternative steel and concrete target 120 as desired. Therefore, the spirit and scope of the appended claims should not be limited to the description of the preferred versions contained herein.

What is claimed is:

1. An alternative steel and concrete target comprising:

a concrete filled base structure;

at least one base structure threaded rod passing through said concrete filled base structure, wherein said base structure threaded rod includes a first threaded portion extending outward from a front side of said concrete filled base structure, and a second threaded portion extending outward from a rear side of said concrete filled base structure;

a first nut threaded onto said first threaded portion of said base structure threaded rod;

a second nut threaded onto said second portion of said base structure threaded rod;

a concrete filled top module placed on top of and in physical contact with said base structure;

at least one module threaded rod passing through said top module, said module threaded rod having a third threaded portion extending outward from said top module;

a third nut threaded onto the third threaded portion of said module threaded rod;

a pipe inserted into said top module through an opening, wherein said pipe is welded to said top module at a point where said pipe is in contact with an opening edge of said concrete filled top module; and a mock gun barrel inserted into said pipe.

2. The alternative steel and concrete target of claim 1, wherein said concrete filled base structure and said concrete filled top module are filled with a concrete mixture having a compressive force rating of at least four thousand pounds per square inch (psi).

3. The alternative steel and concrete target of claim 1, wherein said concrete filled base structure is further comprised of a plurality of individual base modules.

4. The alternative steel and concrete target of claim 1, wherein said concrete filled base structure is further comprised of a mild steel exterior, and said mild steel exterior is between one quarter inches and two inches in thickness, said thickness increasing in a direct proportion to an exposure of said mild steel to a high explosive blast.

5. The alternative steel and concrete target of claim 1, wherein said concrete filled top module is further comprised of a mild steel exterior, and said mild steel exterior is at least one half inch in thickness.

6. The alternative steel and concrete target of claim 1, wherein said concrete filled base structure and said concrete filled top module are arranged to represent a tank.

7. The alternative steel and concrete target of claim 1, wherein said concrete filled base structure and said concrete filled top module are arranged to represent an armored personnel carrier.

8. A concrete filled high explosive target comprising:

a plurality of concrete filled base modules forming a base structure for supporting a concrete filled top module, at least one base structure threaded rod passing through said plurality of concrete filled base modules;

a first nut threaded onto a first threaded portion of said base structure threaded rod;

a second nut threaded onto a second portion of said base structure threaded rod;

said first nut and said second nut being tightened to produce a first compressive force upon said plurality of concrete filled base modules, wherein said first compressive force draws together said plurality of concrete filled base modules;

said concrete filled top module being placed on top of and in physical contact with said base structure;

at least one module threaded rod passing through said top module, said module threaded rod having a third threaded portion extending outward from said top module;

a third nut threaded onto the third threaded portion of said module threaded rod;

said third nut being tightened to produce a second compressive force upon said concrete filled top module, wherein said second compressive force draws together said concrete filled top module and said concrete filled base modules;

a pipe inserted into an opening in said top module; and a mock gun barrel inserted into said pipe.

9. The concrete filled high explosive target of claim 8, wherein said concrete filled base structure and said concrete filled top module withstand a high explosive fragmentation blast.

10. The concrete filled high explosive target of claim 8, wherein said plurality of concrete filled base modules are further comprised of a mild steel exterior, and said mild steel exterior is at least one quarter inch in thickness.

11. The concrete filled high explosive target of claim 8, wherein said concrete filled top module is further comprised of a mild steel exterior, and said mild steel exterior is at least one quarter inch in thickness.

12. The concrete filled high explosive target of claim 8, wherein said plurality of concrete filled base modules and said concrete filled top module are arranged to represent a tank, and said plurality of concrete filled base modules and said concrete filled top module withstand a high explosive fragmentation blast.

13. The concrete filled high explosive target of claim 12, wherein a concrete mixture is used to fill said concrete filled base structure and said concrete filled top module, and said concrete mixture has a compressive force rating of at least four thousand pounds per square inch (psi).

14. The concrete filled high explosive target of claim 8, wherein said plurality of concrete filled base modules and said concrete filled top module are arranged to represent an armored personnel carrier, and said plurality of concrete filled base modules and said concrete filled top module withstand a high explosive fragmentation blast.

15. The concrete filled high explosive target of claim 14, wherein a concrete mixture is used to fill said concrete filled base structure and is used to fill said concrete filled top module, and said concrete mixture has a compressive force rating of at least four thousand pounds per square inch (psi).

16. A reconfigurable high explosive target comprising:

means for simulating a lower portion of a surplus military vehicle forming a simulated vehicle lower portion;

means for simulating an upper portion of said surplus military vehicle forming a simulated vehicle upper portion;

means for compacting said lower said simulated vehicle lower portion;

means for securing said simulated vehicle upper portion to said simulated vehicle lower portion;

means for connecting a first plurality of shackles to said simulated vehicle upper portion;

means for connecting a second plurality of shackles to said simulated vehicle lower portion;

means for reinforcing said first plurality of shackles and said second plurality of shackles;

means for simulating a gun barrel forming a simulated gun barrel;

means for securing said simulated gun barrel to said simulated vehicle upper portion; and means for protecting said simulated vehicle upper portion and said simulated vehicle lower portion of said surplus military vehicle from a high explosive blast.

17. The reconfigurable high explosive target of claim 16, wherein said simulated vehicle upper portion and said simulated vehicle lower portion are clad in a mild steel skin, said mild steel skin is at least one half inch in thickness.

18. The reconfigurable high explosive target of claim 16, wherein said simulated vehicle upper portion and said simulated vehicle lower portion are filled with a concrete mixture, and said concrete mixture has a compressive force rating of at least four thousand pounds per square inch (psi).

19. The reconfigurable high explosive target of claim 16, wherein said means for compacting said simulated vehicle lower portion of said surplus military vehicle includes a plurality of threaded rods, and said plurality of threaded rods are made from a 1¼"-7 B7 steel alloy.

20. The reconfigurable high explosive target of claim 16, wherein said means for securing said simulated vehicle upper portion to said simulated vehicle lower portion includes a plurality of threaded rods, and said plurality of threaded rods are made from a 1¼"-7 B7 steel alloy.

21. An alternative steel and concrete target comprising:

a concrete filled base structure;

a pair of base structure threaded rods passing through said concrete filled base structure, wherein said base structure threaded rods includes a first threaded portion extending outward from a front side of said concrete filled base structure, and a second threaded portion extending outward from a rear side of said concrete filled base structure;

a first nut threaded onto said first threaded portion of said base structure threaded rods;

a second nut threaded onto said second portion of said base structure threaded rods;

a concrete filled top module placed on top of and in physical contact with said base structure;

a plurality of threaded rods passing through said top module, each of said module threaded rods having a third threaded portion extending outward from said top module;

a third nut threaded onto the third threaded portion of each of said module threaded rods;

a plurality of lifting brackets welded to said concrete filled base structure and welded to said concrete filled top module;

a pipe inserted into said top module through an opening, wherein said pipe is welded to said top module at a point where said pipe is in contact with an opening edge of said concrete filled top module; and a mock gun barrel inserted into said pipe.

22. The alternative steel and concrete target of claim 21 wherein said pipe is closed at one end by an end plate.

23. The alternative steel and concrete target of claim 21 wherein said concrete filled base structure includes a plurality of reinforcing rods.

24. The alternative steel and concrete target of claim 21 wherein said concrete filled top module includes a plurality of reinforcing rods.

25. The alternative steel and concrete target of claim 21 wherein said concrete filled base structure includes a plurality of reinforcing rods that are at least ⅝ inches in diameter.

26. The alternative steel and concrete target of claim 21 wherein said concrete filled top module includes a plurality of reinforcing rods that are at least ⅝ inches in diameter.

* * * * *